US007766439B2

(12) United States Patent
Kondo

(10) Patent No.: US 7,766,439 B2
(45) Date of Patent: Aug. 3, 2010

(54) RECORDING APPARATUS

(75) Inventor: Hirofumi Kondo, Tajimi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1177 days.

(21) Appl. No.: 11/373,961

(22) Filed: Mar. 14, 2006

(65) Prior Publication Data

US 2006/0214899 A1 Sep. 28, 2006

(30) Foreign Application Priority Data

Mar. 14, 2005 (JP) ..... 2005-071114

(51) Int. Cl.
*B41J 29/38* (2006.01)

(52) U.S. Cl. ..... 347/10; 347/11; 347/12

(58) Field of Classification Search ..... 347/10–12
See application file for complete search history.

(56) References Cited

U.S. PATENT DOCUMENTS 5,975,667 A * 11/1999 Moriguchi et al. ..... 347/10
6,338,537 B1 * 1/2002 Nou ..... 347/9
2006/0197790 A1 * 9/2006 Ito et al. ..... 347/10

FOREIGN PATENT DOCUMENTS

JP 2000 158643 6/2000

* cited by examiner

*Primary Examiner*—Julian D Huffman
*Assistant Examiner*—Jason S Uhlenhake
(74) *Attorney, Agent, or Firm*—Baker Botts L.L.P.

(57) ABSTRACT

A recording apparatus including: a recording head having a plurality of actuators for performing dot printing; a drive circuit which outputs respective drive pulses to the respective actuators; and a main circuit which transmits, to the drive circuit, a drive signal for outputting the respective drive pulses to the respective actuators. The drive signal includes selection data for selecting, for each of the actuators, a drive-waveform signal which provides a waveform of each of the drive pulses, among plural sorts of drive-waveform signals. The main circuit transmits, to the drive circuit, a clock signal and a drive-waveform-data signal that is a serial signal in which is included data to generate the plural sorts of drive-waveform signals. The drive circuit includes a drive-waveform-signal generating circuit which generates the plural sorts of drive-waveform signals on the basis of the clock signal and the drive-waveform-data signal. The drive circuit selects, for each of the actuators, one of the plural sorts of drive-waveform signals and outputs, to each of the actuators, the drive pulse which is based on said one of the plural sorts of drive-waveform signals selected for said each of the actuators.

12 Claims, 8 Drawing Sheets

RECORDING APPARATUS

The present application is based on Japanese Patent Application No. 2005-071114 filed on Mar. 14, 2005, the contents of which are incorporated herein by reference.

BACKGROUND OF THE INVENTION

1. Field of the Invention

The present invention relates in general to a recording apparatus such as an ink-jet type recording apparatus.

2. Discussion of Related Art

There is conventionally known, as a recording apparatus, an ink-jet type recording apparatus which is arranged to perform recording such that an ink-jet head held by a carriage ejects ink droplets toward a recording medium which is disposed so as to be opposed to the ink-jet head with a predetermined spacing distance therebetween while the ink-jet head is moved along the recording medium.

As such an ink-jet type recording apparatus, there is known one, as disclosed in JP-A-2000-158643, whose ink-jet head (hereinafter referred to as "recording head") is equipped with a drive circuit to which a record data signal and various control signals are inputted from a main circuit provided on a main body of the apparatus. In this apparatus, the recording head having ink ejection nozzles respectively corresponding to a plurality of channels is driven by the drive circuit.

In the conventional recording head described above, a drive-waveform signal is inputted to the drive circuit for driving the recording head. In some cases, a plurality of mutually different drive waveforms need to be prepared in order to eject ink droplets with a plurality of mutually different volume values for tone printing or the drive-waveform signal needs to be changed for each of blocks or each of rows of the nozzles for the purpose of reducing the peak of the power to be consumed or avoiding a crosstalk phenomenon. Further, because plural sorts of ink having respective different characteristics are used in a color printing operation, there is a demand to employ a drive waveform optimum for each of the respective characteristics of the plural sorts of ink. In those cases, the number of kinds of the drive waveform inevitably increases. With an increase in the number of kinds of the drive waveform, the number of signal lines through which the drive-waveform signal is inputted to the drive circuit increases.

The increase in the number of the signal lines makes the signal lines complicated. In addition, where a flexible flat cable is used for transmitting signals from the main circuit of the main body of the recording apparatus to the drive circuit of the recording head, the flexible flat cable inevitably has an increased width, resulting in complicated connection of the flexible flat cable and increased costs in production and maintenance of the recording apparatus.

In view of the above, it is proposed in the above-identified publication JP-A-2000-158643 to reduce the number of the signal lines through which the drive-waveform signals are inputted to the drive circuit provided on the recording head from the main circuit provided on the main body of the recording apparatus by mounting drive-waveform-signal generating circuits on the recording head. Namely, data such as a pulse width necessary for generating the drive-waveform signals is serially transmitted beforehand to the drive-waveform-signal generating circuits mounted on the recording head and the drive-waveform-signal generating circuits are arranged to respectively output, on the basis of the data, the drive-waveform signals concurrently with initiation of the recording operation.

SUMMARY OF THE INVENTION

In the proposed technique disclosed in the above-identified publication, the number of the signal lines through which the drive-waveform signals are inputted to the drive circuit provided on the recording head from the main circuit provided on the main body of the recording apparatus is reduced. However, the drive-waveform-signal generating circuits are additionally required. Further, the drive-waveform-signal generating circuits need to be provided for the respective kinds of the drive waveform. Thus, the weight of the recording head is undesirably increased.

It is therefore an object of the present invention to provide a recording apparatus capable of transmitting a signal relating to a drive waveform from a main circuit to a drive circuit by provision of a reduced number of signal lines smaller than the number of kinds of the drive waveform, without mounting, on the drive circuit, the same number of drive-waveform-signal generating circuits as the number of kinds of the drive waveform.

The object indicated above may be achieved according to a principle of the invention, which provides a recording apparatus comprising: a recording head having a plurality of actuators for performing dot printing; a drive circuit which outputs respective drive pulses to the respective actuators; and a main circuit which transmits, to the drive circuit, a drive signal for outputting the respective drive pulses to the respective actuators. The drive signal transmitted by the main circuit to the drive circuit includes selection data for selecting, for each of the actuators, a drive-waveform signal which provides a waveform of each of the drive pulses to be outputted to the respective actuators, among plural sorts of drive-waveform signals. The main circuit transmits, to the drive circuit, a clock signal and a drive-waveform-data signal that is a serial signal in which is included data to generate the plural sorts of drive-waveform signals. The drive circuit includes a drive-waveform-signal generating circuit which generates the plural sorts of drive-waveform signals on the basis of the clock signal and the drive-waveform-data signal. The drive circuit selects, for each of the actuators, one of the plural sorts of drive-waveform signals generated by the drive-waveform-signal generating circuit and outputs, to each of the actuators, the drive pulse which is based on said one of the plural sorts of drive-waveform signals selected for said each of the actuators.

In the present recording apparatus constructed as described above, the drive-waveform-signal generating circuit of the drive circuit generates the plural sorts of drive-waveform signals on the basis of the clock signal transmitted from the main circuit and the drive-waveform-data signal which is a serial signal and which is transmitted from the main circuit. Therefore, the present arrangement enables the drive-waveform-data signal to be transmitted to the drive circuit by provision of a reduced number of signal lines smaller than the number of kinds of the drive pulse, without mounting, on the drive circuit, the same number of drive-waveform-signal generating circuits as the number of kinds of the drive pulse.

The above-indicated drive-waveform-signal generating circuit may be arranged to generate (a) at least one sort of first drive-waveform signal as a part of the plural sorts of drive-waveform signals on the basis of states of the drive-waveform-data signal which correspond to rising edges of clock pulses of the clock signal and (b) at least one sort of second drive-waveform signal as another part of the plural sorts of drive-waveform signals on the basis of states of the drive-waveform-data signal which correspond to falling edges of the clock pulses of the clock signal. In this arrangement, by utilizing not only the rising edges of the clock pulses of the clock signal but also the falling edges of the clock pulses, it is possible to generate at least two sorts of drive-waveform signals, i.e., the first and second drive-waveform signals, from one drive-waveform-data signal. The at least two sorts of drive-waveform signals may constitute all or a part of the plural sorts of drive-waveform signals.

The above-indicated drive-waveform-signal generating circuit may be arranged to include a serial-parallel conversion portion which generates some of the plural sorts of drive-waveform signals as at least a part thereof, by conducting serial-parallel conversion of the drive-waveform-data signal on the basis of clock pulses of the clock signal. In this arrangement, the serial-parallel conversion portion conducts serial-parallel conversion of the drive-waveform-data signal, thereby generating some of the plural sorts of drive-waveform signals as at least a part thereof.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF THE PREFERRED EMBODIMENTS

Figure 1:
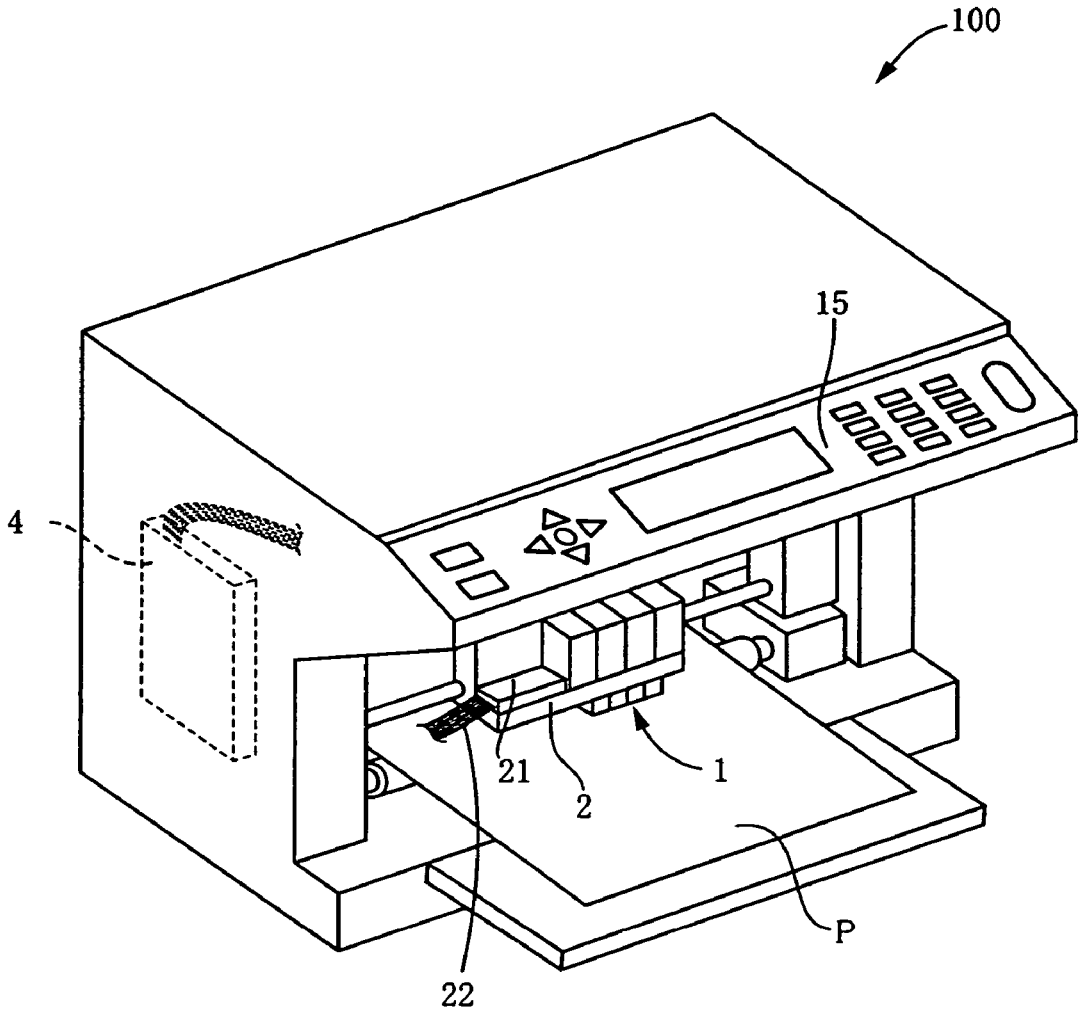
FIG. 1 is a perspective view of an ink-jet type recording apparatus to which a principle of the present invention is applied.

There will be described embodiments of the present invention by referring to the drawings.

Figure 2:
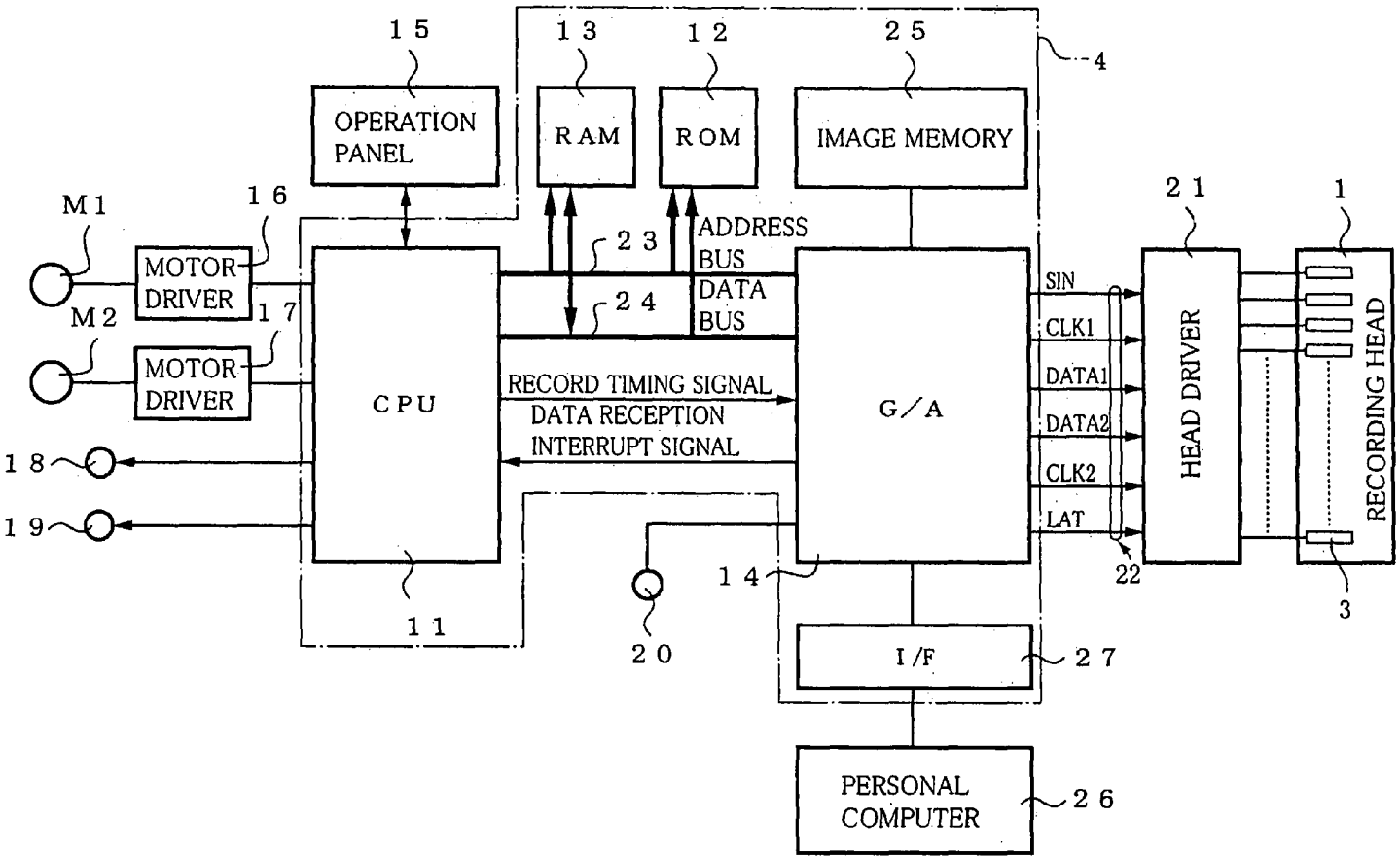
FIG. 2 is a block diagram showing an electric structure of the recording apparatus of FIG. 1 according to a first embodiment of the invention.

FIG. 1 shows an ink-jet type recording apparatus 100 to which the principle of the present invention is applied and FIG. 2 is a block diagram showing an electric structure of a control device according to a first embodiment, which controls the recording apparatus 100.

As shown in FIGS. 1 and 2, the control device of the ink-jet type recording apparatus 100 is equipped with a main circuit 4 that includes: a CPU 11 which performs processing of a record data signal (print data signal) and controls an operation of the recording apparatus 100; a ROM 12 which stores programs executed by the CPU 11; a RAM 13 which temporarily stores data in the data processing by the CPU 11; and a gate array (G/A) 14 which is a gate circuit LSI (large scale integrated circuit). To the CPU 11, there are connected: an operation panel 15 through which an operator or user inputs commands such as printing; a motor drive circuit 16 which drives a carriage motor M1 for reciprocating a carriage 2; a motor drive circuit 17 which drives a line-feed motor M2 for feeding a recording sheet P as a recording medium in a predetermined direction; a paper sensor 18 which detects a leading edge of the recording sheet P; and a home position sensor 19 which detects a home position of the carriage 2 on which is mounted a recording head 1.

The recording head 1 is driven by a head driver 21 as a drive circuit. The head driver 21 is mounted on the carriage 2 together with the recording head 1. The head driver 21 and the gate array 14 are connected to each other by a harness cable (flexible flat cable) 22, whereby the head driver 21 is controlled by the gate array 14.

While not shown specifically, the recording head 1 is arranged to eject ink droplets from nozzles by individually changing a volume of ink chambers accommodating plural sorts of ink, as a result of driving of a plurality of actuators 3 which respectively correspond to the ink chambers and each of which is formed of a piezoelectric element or an electrostrictive element. A pair of electrodes for driving each actuator 3 are provided for each nozzle so as to be connected to the head driver 21. The head driver 21 generates, under control of the gate array 14, drive pulses having respective drive waveforms which are suited for the recording head 1 and outputs the drive pulses to the plural pairs of electrodes. There is connected, to the gate array 14, an encoder sensor 20 for detecting the position of the carriage 2.

The CPU 11 is connected to the ROM 12, the RAM 13 and the gate array 14 via an address bus 23 and a data bus 24. The CPU 11 generates a record timing signal and a reset signal in accordance with the programs pre-stored in the ROM 12 and transmits the signals to the gate array 14. A drive-waveform-data signal (DATA) for generating drive-waveform signals (FIRE) is pre-stored in the ROM 12. Alternatively, the drive-waveform-data signal (DATA) is first transmitted from a host computer 26 via an interface (I/F) 27 together with the record data signal and then stored in the RAM 13 or an image memory 25. The thus stored drive-waveform-data signal (DATA) is outputted to the gate array 14 when the printing operation is performed. The main circuit 4 is constituted by including the CPU 11, the ROM 12, the RAM 13, the gate array 14, the image memory 25 and the interface 27. The drive-waveform-data signal (DATA) and the drive-waveform signals (FIRE) will be explained in detail.

The gate array 14 controls the image memory 25 to store image data transmitted, via the interface 27, from the host computer (personal computer) 26 as an external device. Further, the gate array 14 generates a data reception interrupt signal on the basis of data transmitted from the host computer 26 via the interface 27 and transmits the generated signal to the CPU 11. The gate array 14 generates a clock signal CLK1 and a latch signal LAT in accordance with the record timing signal and a control signal from the encoder sensor 20 and transmits, in synchronism with the clock signal CLK1, a drive signal SIN to the head driver 21. The drive signal SIN is for forming the image data on the recording medium on the basis of the image data stored in the image memory 25. The gate array 14 generates, in accordance with the record timing signal and the control signal from the encoder sensor 20, a clock signal CLK2 whose period is different from that of the clock signal CLK1 and transmits, to the head driver 21, drive-waveform-data signals DATA1, DATA2 in synchronism with the clock signal CLK2. The data communication between the gate array 14 and the head driver 21 is conducted through the harness cable 22 connecting the gate array 14 and the head driver 21 to each other. The above-indicated signals SIN, DATA1, DATA2, CLK, etc., are transmitted to the head driver 21 via the harness cable 22, so that the number of signal lines for transmission of the signals can be reduced.

Figure 3:
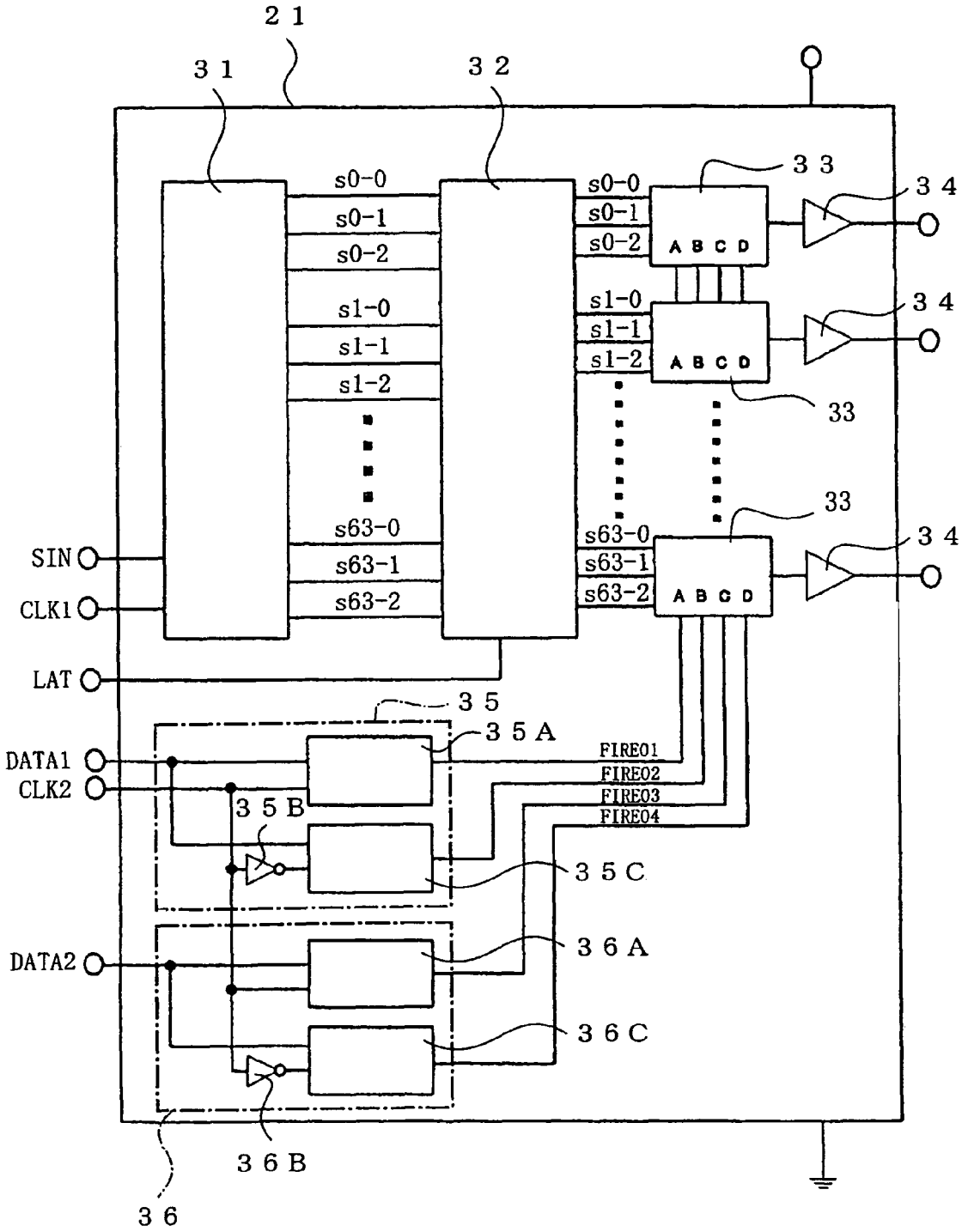
FIG. 3 is a block diagram schematically showing a structure of a head driver according to the first embodiment.

As shown in FIG. 3, the head driver 21 includes a main serial-parallel conversion circuit 31, a main latch circuit 32, selectors 33, drivers 34, a first drive-waveform-signal generating circuit 35 and a second drive-waveform-signal generating circuit 36. The main serial-parallel conversion circuit 31 conducts serial-parallel conversion of the drive signal SIN, that is, converts the drive signal SIN into parallel signals s0-0, s0-1, S0-2; s1-0, s1-0, s1-2; . . . , s63-0, s63-1, s63-2, which parallel signals respectively correspond to the respective actuators 3. The first drive-waveform-signal generating circuit 35 and the second drive-waveform-signal generating circuit 36 respectively convert the drive-waveform-data signals DATA1 and DATA2 to plural sorts of drive-waveform signals (FIRE). The first and second drive-waveform-signal generating circuits 35, 36 are disposed in parallel.

The first drive-waveform-signal generating circuit 35 includes: a latch circuit 35A which generates a first drive-waveform signal (FIRE01) on the basis of a state of the drive-waveform-data signal DATA1, which state corresponds to a rising edge of each of clock pulses of the clock signal CLK2 transmitted from the gate array 14; and an inversion circuit 35B and a latch circuit 35C which generate a second drive-waveform signal (FIRE02) on the basis of a state of the drive-waveform-data signal DATA1, which state corresponds to a falling edge of each of the clock pulses. The second drive-waveform-signal generating circuit 36 includes: a latch circuit 36A which generates a first drive-waveform signal (FIRE03) on the basis of a state of the drive-waveform-data signal DATA2, which state corresponds to the rising edge of each of the clock pulses of the clock signal CLK2; and an inversion circuit 36B and a latch circuit 36C which generate a second drive-waveform signal (FIRE04) on the basis of a state of the drive-waveform-data signal DATA2, which state corresponds to the falling edge of each of the clock pulses. Each of the latch circuits 35A, 36A corresponds to a first circuit portion. Each of the combination of the latch circuit 35C and the inversion circuit 35B or the combination of the latch circuit 36C and the inversion circuit 36B corresponds to a second circuit portion.

The first and second drive-waveform signals (FIRE01, FIRE02) generated by the respective latch circuits 35A, 35C and the first and second drive-waveform signals (FIRE03, FIRE04) generated by the respective latch circuits 36A, 36C are outputted, as the plural sorts (four sorts) of drive-waveform signals (FIRE01-04) to each of the selectors 33.

Where the recording head 1 is a 64-channel multi head having sixty-four ink chambers, for instance, the main serial-parallel conversion circuit 31 is constituted by shift registers of 64-bit length. To the main serial-parallel conversion circuit 31, there is inputted the drive signal SIN serially transmitted from the gate array 14 in synchronism with the clock signal CLK1, and the drive signal SIN is converted into the parallel signals in accordance with a rising edge of each of clock pulses of the clock signal CLK1. By the serial-parallel conversion of the drive signal SIN, selection signals (selection data) s0-0, s0-1, s0-2; s1-0, s1-1, s1-2; . . . ; s63-0, s63-1, s63-2 are set for the respective channels. Namely, the parallel signals which are obtained by the serial-parallel conversion of the drive signal SIN are constituted by the 3-bit selection signals, respectively. Depending upon the combination of the bits, no-recording or one of the plural sorts of drive-waveform signals (four sorts in the present embodiment, i.e., FIRE01-04) is selected.

The main latch circuit 32 holds the parallel signals which are generated by the main serial-parallel conversion circuit 31 so as to correspond to the respective actuators 3 of the recording head 1, in accordance with rising edges of pulses of the latch signal LAT transmitted from the gate array 14.

In the first circuit portion of the first drive-wave form-signal generating circuit 35, the drive-waveform-data signal DATA1 serially transmitted from the gate array 14 in synchronization with the clock signal CLK2 is inputted directly to the latch circuit 35A while, in the second circuit portion, the drive-waveform-data signal DATA1 is inputted to the latch circuit 35C in synchronization with an inverted signal of the clock signal CLK2 which has been passed through the inversion circuit 35B. In the first circuit portion of the second drive-waveform-signal generating circuit 36, the drive-waveform-data signal DATA2 serially transmitted from the gate array 14 in synchronization with the clock signal CLK2 is inputted directly to the latch circuit 36A while, in the second circuit portion, the drive-waveform-data signal DATA2 is inputted to the latch circuit 36C in synchronization with an inverted signal of the clock signal CLK2 which has been passed through the inversion circuit 36B.

Figure 4:
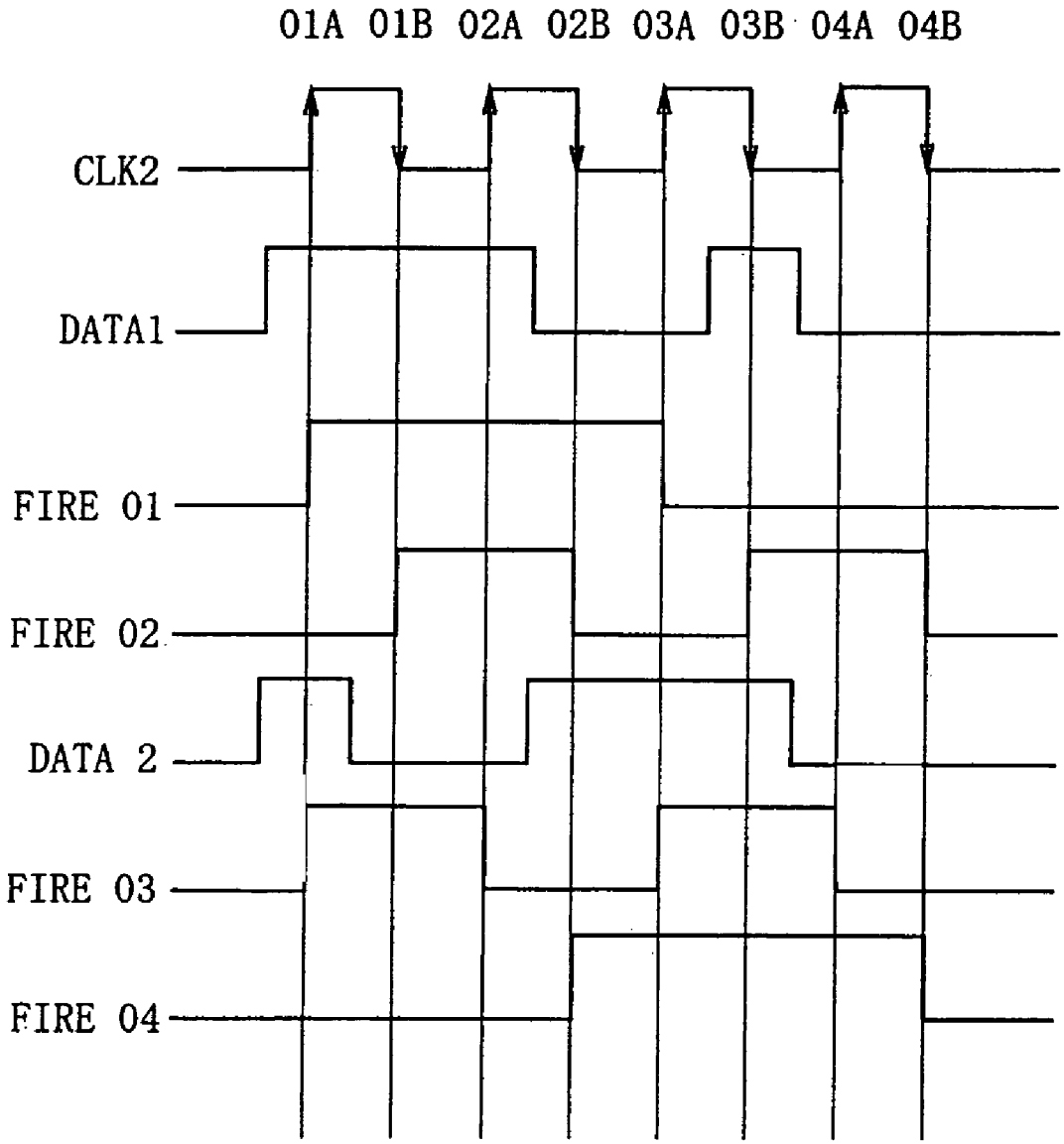
FIG. 4 is a timing chart of the operation of the head driver of FIG. 3.
Figure 5:
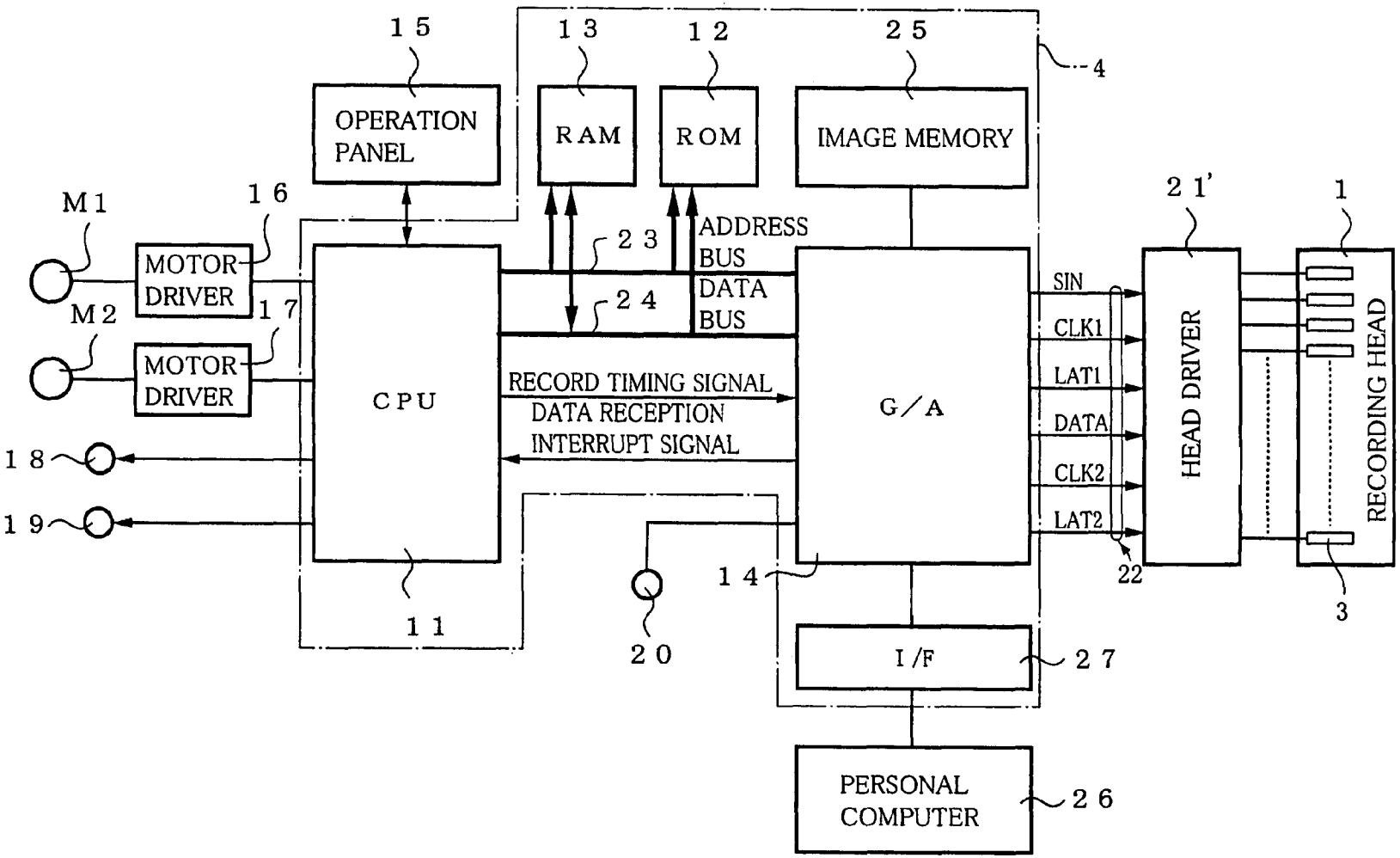
FIG. 5 is a block diagram showing an electric structure of the recording apparatus of FIG. 1 according to a second embodiment of the invention.

As shown in FIG. 4, in the first circuit portion of the first drive-waveform generating circuit 35, the states of the drive-waveform-data signal DATA1 which respectively correspond to the rising edges of the clock pulses of the clock signal CLK2 are converted into the signal FIRE01 while, in the second circuit portion, the states of the drive-waveform-data signal DATA1 which respectively correspond to the falling edges of the clock pulses of the clock signal CLK2 are converted into the signal FIRE02. In the first circuit portion of the second drive-waveform-signal generating circuit 36, the states of the drive-waveform-data signal DATA2 which respectively correspond to the rising edges of the clock pulses of the clock signal CLK2 are converted into the signal FIRE 03 while, in the second circuit portion, the states of the drive-waveform-data signal DATA2 which respectively correspond to the falling edges of the clock pulses of the clock signal CLK2 are converted into the signal FIRE04. These drive-waveform signals FIRE01-04 are outputted to each of the sixty-four selectors 33 provided for the respective channels.

The selectors 33 respectively select, on the basis of the parallel signals (including the selection signals s0-0, s0-0-1, s0-2; s1-0, s1-1, s1-2; . . . ; s63-0, s63-1, s63-2) outputted from the main serial-parallel conversion circuit 31, one of the plural sorts of drive-waveform signals FIRE01-04 transmitted from the first and second drive-waveform-signal generating circuits 35, 36 (the latch circuits 35A, 36A, 35C, 36C), and the drive-waveform signal selected by each selector 33 is outputted to the corresponding driver 34. Where four sorts of drive-waveform signals (FIRE01-04) having mutually different pulse numbers are prepared and the drive signal (SIN) includes the 3-bit signals (s0-0, s0-1, s0-2; s1-0, s1-1, s1-2; . . . ; s63-0, s63-1, s63-2), for instance, one of the four drive-waveform signals is selected depending upon the input of the selection signal to each selector 33. More specifically explained, where the combination of the bits in each selection signal is 0,0,0, non-recording is selected. Where the combination of the bits is 0,0,1, the drive-waveform signal FIRE01 is selected. Where the combination of the bits is 0,1,0, the drive-waveform signal FIRE02 is selected. Where the combination of the bits is 1,0,0, the drive-waveform signal FIRE03 is selected. Where the combination of the bits is 1,1,0, the drive-waveform signal. FIRE04 is selected. Thus, there can be attained, for each nozzle, five tones including non-recording.

Each of the drivers 34 generates, on the basis of one of the drive-waveform signals FIRE01-04 which is selected by and outputted from the corresponding selector 33, a drive pulse of the voltage suitable for the recording head 1, and outputs, to the pair of electrodes of the corresponding ink chamber (to the corresponding actuator 3). The generated drive pulse has a waveform provided by the selected drive-waveform signal. Accordingly, it is possible to precisely control each of the actuators 3, thereby simplifying the control of the amount of the ink droplets to be ejected.

If the recording head 1 is not the 64-channel type, the bit length of the main serial-parallel conversion circuit 31 and the respective numbers of the selectors 33 and the drivers 34 are made equal to the number of the channels of the recording head 1.

Referring next to the timing chart for various signals transmitted to the head driver 21 shown in FIG. 4, there will be explained timing of processing of each signal in the head driver 21.

The drive signal SIN is read out from the image memory 25 by the gate array 14 and serially transmitted to the head driver 21 via the flexible flat cable 22. Further, the drive-waveform-data signals DATA1, DATA2, the clock signals CLK1, CLK2 and the latch signal LAT are also serially transmitted from the gate array 14 to the head driver 21 via the flexible flat cable 22.

As shown in FIG. 4, each of the drive-waveform-data signals DATA1, DATA2 outputted from the gate array 14 serially includes, from the beginning, states of each of the drive-waveform-data signals DATA1, DATA2 corresponding to the respective clock pulses of the clock signal CLK2, as data of each of states of the corresponding two sorts of drive-waveform signals FIRE01, 02 or FIRE 03, 04. Further, the overall signal state of each drive-waveform-data signal DATA1, DATA2 varies plural times in a time-series direction of the plurality of clock pulses such that each drive-waveform signal FIRE01-04 includes one or more pulses.

The first drive-waveform-signal generating circuit 35 controls the latch circuit 35A to hold, as the respective states of the signal FIRE01, the states of the drive-waveform-data signal DATA1 which respectively correspond to the rising edges 01A-04A of the respective clock pulses of the clock signal CLK2 and controls the latch circuit 35C to hold, as the respective states of the signal FIRE02, the states of the drive-waveform-data signal DATA1 which respectively correspond to the falling edges o1B-04B of the respective clock pulses of the clock signal CLK2.

The second drive-waveform-signal generating circuit 36 controls the latch circuit 36A to hold, as the respective states of the signal FIRE03, the states of the drive-waveform-data signal DATA2 which respectively correspond to the rising edges 01A-04A of the respective clock pulses of the clock signal CLK2 and controls the latch circuit 36C to hold, as the respective states of the signal FIRE04, the states of the drive-waveform-data signal DATA2 which respectively correspond to the falling edges 01B-04B of the respective clock pulses of the clock signal CLK2.

More detailed explanation will be made referring to FIG. 4. For the drive-waveform-data signal DATA1, the state of the drive-waveform-data signal DATA 1 corresponding to the rising edge 01A of the first clock pulse is at the level "1", so that the latch circuit 35A holds the level "1" as the first state of the drive-waveform signal FIRE01. The state of the signal DATA1 corresponding to the rising edge 02A of the second clock pulse is at the level "1", so that the latch circuit 35A holds the level "1" as the second state of the drive-waveform signal FIRE01. Similarly, the latch circuit 35A holds the level "0" as the third state of the signal FIRE01 corresponding to the rising edge 03A of the third clock pulse and the level "0" as the fourth state of the signal FIRE01 corresponding to the rising edge 04A of the fourth clock pulse. In the meantime, the state of the drive-waveform-data signal DATA 1 corresponding to the falling edge 01B of the first clock pulse is at the level "1", so that the latch circuit 35C holds the level "1" as the first state of the drive-waveform signal FIRE02. The state of the signal DATA1 corresponding to the falling edge 02B of the second clock pulse is at the level "0", so that the latch circuit 35C holds the level "0" as the second state of the drive-waveform signal FIRE02. Similarly, the latch circuit 35C holds the level "1" as the third state of the signal FIRE02 corresponding to the falling edge. 03B of the third clock pulse and the level "0" as the fourth state of the signal FIRE02' corresponding to the falling edge 04B of the fourth clock pulse.

For the drive-waveform-data signal DATA2, the state of the drive-waveform-data signal. DATA 2 corresponding to the rising edge 01A of the first clock pulse is at the level "1", so that the latch circuit 36A holds the level "1" as the first state of the drive-waveform signal FIRE03. The state of the signal DATA2 corresponding to the rising edge 02A of the second clock pulse is at the level "0", so that the latch circuit 36A holds the level "0" as the second state of the drive-waveform signal FIRE03. Similarly, the latch circuit 36A holds the level "1": as the third state of the signal FIRE03 corresponding to the rising edge 03A of the third clock pulse and the level "0" as the fourth state of the signal FIRE03 corresponding to the rising edge 04A of the fourth clock pulse. In the meantime, the state of the drive-waveform-data signal DATA 2 corresponding to the falling edge 01B of the first clock pulse is at the level "0", so that the latch circuit 36C holds the level "0" as the first state of the drive-waveform signal FIRE04. The state of the signal DATA2 corresponding to the falling edge 02B of the second clock pulse is at the level "1", so that the latch circuit 36C holds the level "1" as the second state of the drive-waveform signal FIRE04. Similarly, the latch circuit 36C holds the level "1" as the third state of the signal FIRE04 corresponding to the falling edge 03B of the third clock pulse and the level "0" as the fourth state of the signal FIRE04 corresponding to the falling edge 04B of the fourth clock pulse.

Thus, in a manner similar to that described above, the voltage level of each drive-waveform signal FIRE01-04 is changed on the basis of the clock pulses of the clock signal CLK2, in accordance with the content of the corresponding drive-waveform-data signal DATA1, DATA2. As a consequence, the drive-waveform signals FIRE01-04 are formed to have respective waveforms each including one or more pulses and inputted to each of the selectors 33. Accordingly, the drive-waveform signals FIRE01-04 are generated by utilizing the falling edges of the clock pulses of the clock signal CLK2 as well as the rising edges of the clock pulses. Accordingly, the two sorts of drive-waveform signals (FIRE01,02; FIRE 03,04) are generated from one drive-waveform-data signal (DATA1 or DATA2). In this arrangement, therefore, the plural sorts of drive-waveform signals (FIRE01-04) can be transmitted to each selector 33.

In the respective selectors 33, non-recording or one of the plural sorts of drive-waveform signals FIRE01-04 inputted from the first and second drive-waveform-signal generating circuits 35, 36 is selected on the basis of the parallel signals (including the selection data s0-0, s0-1, s0-2; s1-0, s1-0, s1-2; . . . ; s63-0, s63-1, s63-2) inputted from the main latch circuit 32. Where one of the drive-waveform signals FIRE01-04 is selected in each selector 33, the selected signal is outputted to the corresponding driver 34. From each driver 34, there is outputted, to the recording head 1, a drive pulse having a waveform defined by the selected drive-waveform signal for ink ejection from the corresponding nozzle (not shown). Thus, the recording head performs the recording (printing) operation.

As long as the recording conditions remain unchanged, the drive-waveform data signals DATA1, DATA2 for generating the drive-waveform signals FIRE01-04 are iteratively read out by the gate array 14 and iteratively outputted as the drive-waveform signals FIRE01-04 from the first and second drive-waveform generating circuits 35, 36. The recording apparatus 100 according to this embodiment is driven such that the length of each drive-waveform signal FIRE01-04 corresponds to a record period of one dot. The period of the lath signal LAT inputted to the main latch circuit 32 may conform to the record period.

While, in the illustrated first embodiment, two kinds of drive-waveform-data signals DATA1, DATA2 are utilized, it is possible to generate much more sorts of drive-waveform signals (FIRE) by utilizing only one drive-waveform-data signal (DATA), according to a second embodiment of the invention explained below referring to FIGS. 5-8. In this instance, the number of the signal lines through which the drive-waveform-data signal is transmitted can be further decreased. In this second embodiment, the reference numerals as used in the illustrated first embodiment are used to identify the corresponding components and a detailed explanation of which is dispensed with in the interest of brevity.

Figure 6:
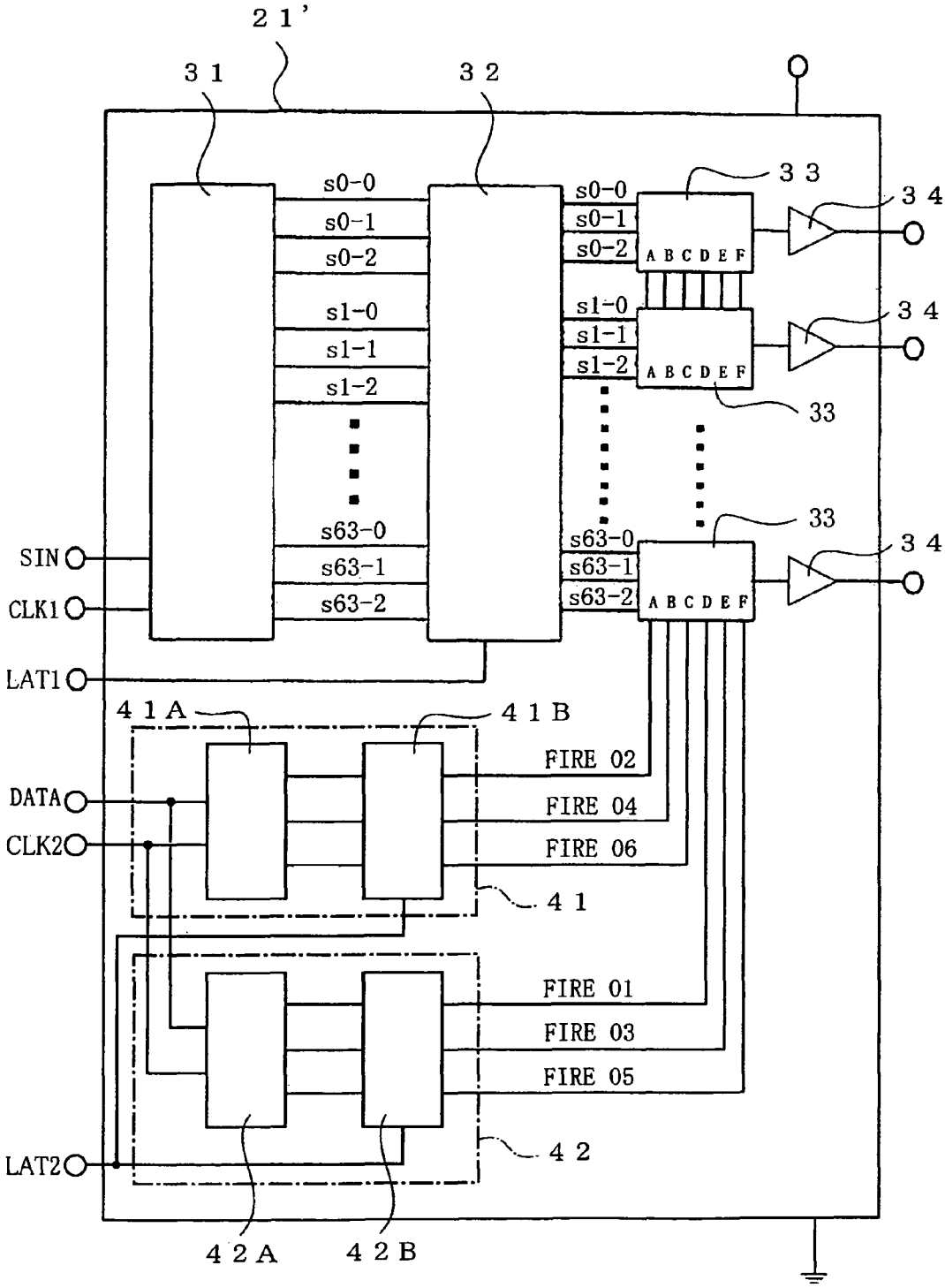
FIG. 6 is a block diagram schematically showing a structure of a head driver according to the second embodiment.

In the second embodiment, the gate array 14 generates latch signals LAT1 and LAT2 and serially transmits, to a head driver 21', a drive-waveform-data signal DATA in synchronism with the clock signal CLK2. Like the head driver 21 in the illustrated first embodiment, the head driver 21' in the second exemplary embodiment includes the main serial-parallel conversion circuit 31, the main latch circuit 32, the selectors 33, the drivers 34, as shown in FIG. 6. The head driver 21' includes a first serial-parallel conversion portion 41 and a second serial-parallel conversion portion 42 which convert the drive-waveform-data signal DATA into plural sorts (six sorts in this embodiment) of drive-waveform signals FIRE01-06, in place of the first and second drive-waveform-signal generating circuits 36, 36 for converting the drive-waveform data signals DATA1, DATA2 into the plural sorts of drive-waveform signals in the illustrated first embodiment. The first serial-parallel conversion portion 41A includes a first serial-parallel conversion circuit 41A and a first latch circuit-41B while the second serial-parallel conversion portion 42 includes a second serial-parallel conversion circuit 42A and a second latch circuit 42B.

Figure 7:
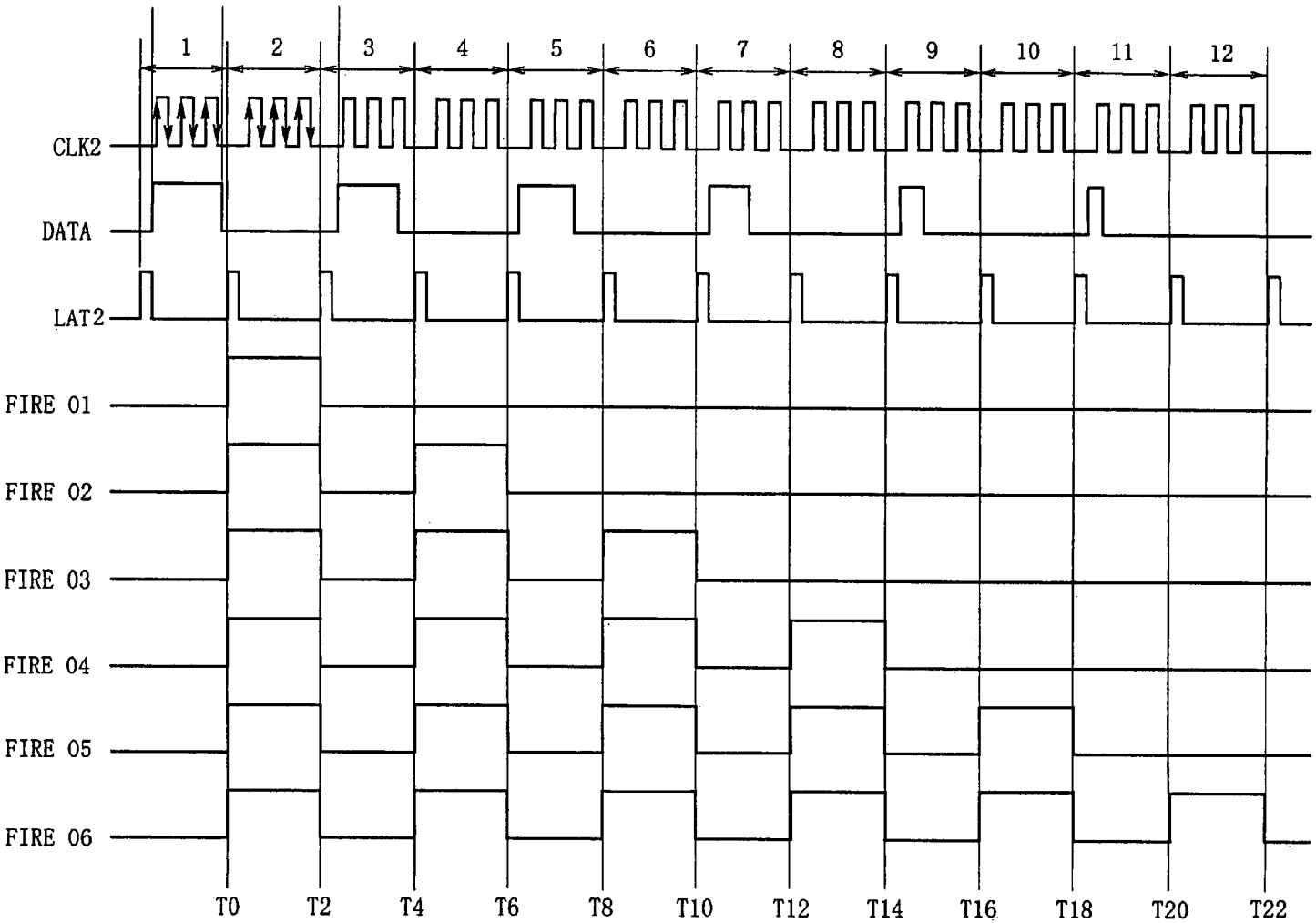
FIG. 7 is a timing chart of the operation of the head driver of FIG. 6.

Because the first and second serial-parallel conversion circuits 41A, 42A disposed in parallel are arranged to respectively generate three sorts of drive-waveform signals, each of the first and second serial-parallel conversion circuits 41A, 42A is constituted by a shift register of 3-bit length. To the respective first and second serial-parallel conversion circuits 41A, 42A, there is inputted the drive-waveform-data signal DATA serially transmitted from the gate array 14 in synchronism with the clock signal CLK2. As shown in FIG. 7, the clock pulses of the clock signal CLK2 are divided into twelve groups such that each group includes three clock pulses. The first serial-parallel conversion circuit 41A converts states of the drive-waveform-data signal DATA which correspond to respective rising edges of three clock pulses in the respective twelve groups, into the respective three parallel signals FIRE02, 04, 06, on the basis of the respective rising edges. In the meantime, the second serial-parallel conversion circuit 42A converts states of the drive-waveform-data signal DATA which correspond to respective falling edges of the three clock pulses in the respective twelve groups, into the respective three parallel signals FIRE01, 03, 05, on the basis of the respective falling edges.

The first latch circuit 41B holds the signals FIRE02, 04, 06 outputted from the first serial-parallel conversion circuit 41A, in accordance with rising edges of pulses of the latch signal LAT2 transmitted from the gate array 14 while the second latch circuit 42B holds the signals FIRE01, 03, 05 outputted from the second serial-parallel conversion circuit 42A, in accordance with the rising edges of the pulses of the latch signal LAT2. On the basis of the rising edges of the pulses of the latch signal LAT2, the first and second latch circuits 41B, 42B respectively outputs, to each selector 33, the signals FIRE02, 04, 06 and the signals FIRE01, 03, 05, so that the plural sorts (i.e., six sorts) of drive-waveform signals FIRE01-06 are inputted to each of the sixty-four selectors 33 provided for the respective channels.

In the respective selectors 33, one of the plural sorts of drive-waveform signals FIRE01-06 transmitted from the first and latch circuits 41B, 42B is selected on the basis of the parallel signals (including the selection data s0-0, s0-1, s0-2; s1-0, s1-1, s1-2; . . . ; s63-0, s63-1, s63-2) outputted from the main latch circuit 32, and the drive-waveform signal selected by each selector 33 is outputted to the corresponding driver 34. In the second exemplary embodiment, there are prepared the six sorts of drive-waveform signals FIRE01-06 having mutually different pulse numbers, and the drive signal SIN includes the 3-bit selection signals (s0-0, s0-1, s0-2; s1-0, s1-1, s1-2; . . . ; s63-0, s63-1, s63-2). One of the six drive-waveform signals FIRE01-06 is selected depending upon the input of the selection signal to each selector 33. Accordingly, there can be attained, for each nozzle, seven kinds of tones including non-recording.

Each of the drivers 34 generates, on the basis of one of the drive-waveform signals FIRE01-06 which is selected by and outputted from the corresponding selector 33, a drive pulse of the voltage suitable for the recording head 1 and outputs, to the pair of electrodes of the corresponding ink chamber (i.e., to the corresponding actuator 3). The generated drive pulse has a waveform defined by the selected drive-waveform signal. Accordingly, it is possible to precisely control each of the actuators 3, thereby simplifying the control of the amount of the ink droplets to be ejected.

Referring next to FIG. 7 showing a timing chart of various signals transmitted to the head driver 21', there will be explained processing timings of each signal in the head driver 21'.

As in the illustrated first embodiment, the drive signal SIN is read out from the image memory 25 by the gate array 14 and serially transmitted to the head driver 21' via the flexible flat cable 22. Further, the drive-waveform-data signal DATA, the clock signals CLK1, CLK2 and the latch signals LAT1, LAT2 are serially transmitted from the gate array 14 to the head driver 21' via the flexible flat cable 22.

Figure 8:
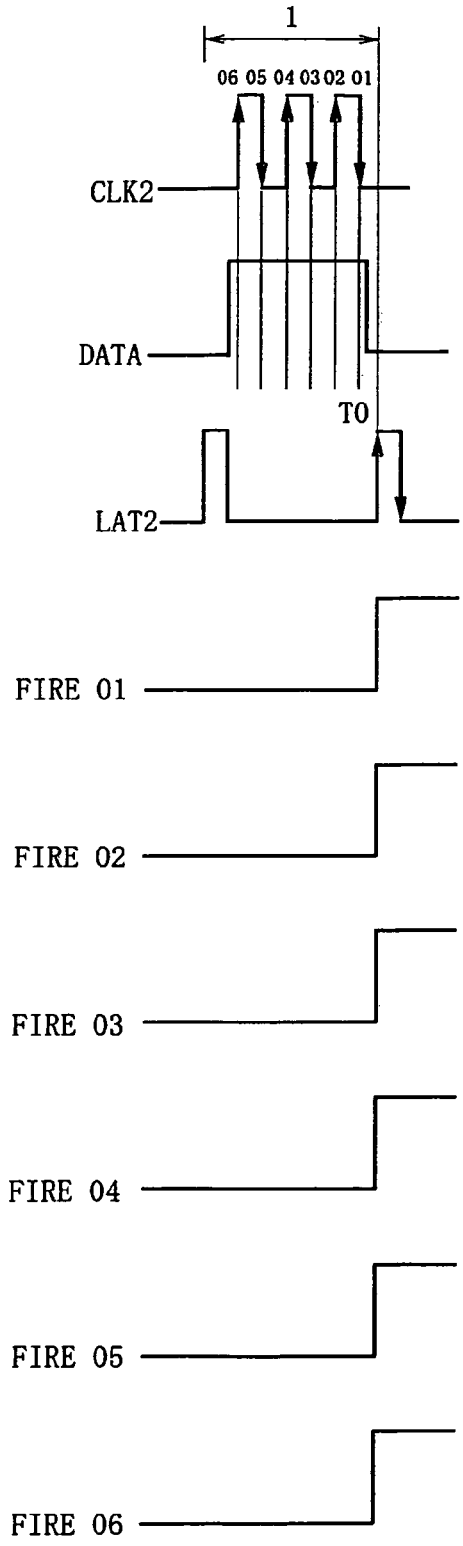
FIG. 8 is an enlarged view showing a part of the timing chart of FIG. 7.

As shown in FIGS. 7 and 8, the drive-waveform-data signal DATA outputted from the gate array 14 serially includes, from the beginning, states of the drive-waveform-data signal DATA corresponding to respective rising edges of the three clock pulses of the clock signal CLK2 in the respective twelve groups, as data of states of the respective drive-waveform signals FIRE 06, 04, 02 and states of the drive-waveform-data signal DATA corresponding to respective falling edges of the three clock pulses of the clock signal CLK2 in the respective twelve groups, as data of states of the respective drive-waveform signals FIRE 05, 03, 01. Further, in order to permit each drive-waveform signal FIRE06-01 to have one or more pulses, the drive-waveform-data signal DATA includes the data of the respective states of the six sorts of drive-waveform signals FIRE06-01 such that the data is divided into twelve portions corresponding to the twelve groups (1-12 shown in FIG. 7) of the clock pulses of the clock signal CLK2, each group including the three clock pulses and interposed between adjacent two pulses of the latch signal LAT2.

The first serial-parallel conversion circuit 41A initially converts the respective states of the drive-waveform-data signal DATA in the first portion which correspond to the respective rising edges 06, 04, 02 of the three clock pulses of the clock signal CLK2 in the first group, into portions of the parallel signals FIRE06, 04, 02 as a part of the plural sorts of drive-waveform signals. Similarly, the second serial-parallel conversion circuit 42A initially converts the respective states of the drive-waveform-data signal DATA in the first portion which correspond to the respective falling edges 05, 03, 01 of the three clock pulses of the clock signal CLK2 in the first group, into portions of the parallel signals. FIRE05, 03,01 as another part of the plural sorts of drive-waveform signals.

For instance, the state of the drive-waveform-data signal DATA corresponding to the rising edge 06 of the first clock pulse in the first group is at the level "1", so that the first state of the drive-waveform signal FIRE06 is made at the level "1". The state of the drive-waveform-data signal DATA corresponding to the rising edge 04 of the second clock pulse in the first group is at the level "1", so that the first state of the drive-waveform signal FIRE04 is made at the level "1". Similarly, the first state of the drive-waveform signal FIRE02 is made at the level "1". In the meantime, the state of the drive-waveform-data signal DATA corresponding the falling edge 05 of the first clock pulse in the first group is at the level "1", so that the first state of the drive-waveform signal FIRE05 is made at the level "1". The state of the drive-waveform-data signal DATA corresponding to the falling edge 03 of the second clock pulse in the first group is at the level"1", so that the first state of the drive-waveform signal FIRE03 is made at the level "1". Similarly, the first state of the drive-waveform signal FIRE01 is made at the level "1".

As shown in FIG. 7, at a timing TO corresponding to a rising edge of one pulse of the latch signal LAT2 at which the level changes from 0 to 1, the first latch circuit 41B incorporates the portions of the respective parallel signals FIRE02, 04, 06 developed in the first serial-parallel conversion circuit 41A while the second latch circuit 42B incorporates the portions of the respective parallel signals FIRE01, 03, 05 developed in the second serial-parallel conversion circuit 42A, whereby the state of the initial portion, i.e., the initial voltage level, of each of the plural sorts of drive-waveform signals FIRE01-06 is determined. Similarly, the states of the drive-waveform data signal DATA in the second portion corresponding to respective rising edges of the three clock pulses in the second group are subjected to serial-parallel conversion by the first serial-parallel conversion circuit 41A while the states of the drive-waveform-data signal DATA in the second portion corresponding to respective falling edges of the three clock pulses in the second group are subjected to serial-parallel conversion by the second serial-parallel conversion circuit 41B. Portions of the signals developed in the respective first and second serial-parallel conversion circuits 41A, 41B are incorporated, at a rising edge of another pulse of the latch signal LAT2 corresponding to a timing T2, by the first and second latch circuits 41B, 42B, respectively. Consequently, the voltage levels of the portions of the respective drive-waveform signals FIRE06-01 determined at the timing TO are changed depending upon the content of the second portion of the drive-waveform-data signal DATA. For instance, the level of the drive-waveform signal FIRE01 which has been raised to "1" at the timing TO is changed to "0" at the timing "0", as shown in FIG. 7.

The voltage levels of portions of the respective drive-waveform signals FIRE01-06 are changed at subsequent timings T4-T22 depending upon the respective contents of the third through the twelfth portions of the drive-waveform-data signal DATA. In the second exemplary embodiment, the width of each of the pulses of the drive-waveform-data signal. DATA which respectively correspond to the first portion, the third portion, the fifth portion, the seventh portion, the ninth portion and the eleventh portion gradually decreases by an amount corresponding to a width of one clock pulse of the clock signal CLK2. Further, because the respective states of the drive-waveform-data signal DATA in the second portion, the fourth potion, the sixth portion, the eighth portion, the tenth portion and the twelfth portion each of which is interposed between suitable adjacent two of the first portion, the third portion, the fifth portion, the seventh portion, the ninth portion and the eleventh portion are placed at the level "0", each of the drive-waveform signals FIRE01-06 includes one or more pulses, namely, in a range from one to six. As a result, each of the drive-waveform signals FIRE01-06 is formed as a pulse wave having a waveform including one or more pulses and is inputted to the corresponding selector 33. Thus, the drive-waveform-data signal DATA can be transmitted while utilizing the falling edges of the respective clock pulses of the clock signal CLK2, in addition to the rising edges of the clock pulses.

In the respective selectors 33, one of the plural sorts of drive-waveform signals FIRE01-06 transmitted from the first and latch circuits 41B, 42B is selected on the basis of the parallel signals (including the selection data s0-0, s0-1, s0-2; s1-0, s1-1, s1-2; . . . ; s63-0, s63-1, s63-2) inputted from the main latch circuit 32, and the drive-waveform signal selected by each selector 33 is outputted to the corresponding driver 34. From each driver 34, there is outputted, to the recording head 1, a drive pulse having a waveform defined by the selected drive-waveform signal for ink ejection from the corresponding nozzle (not shown). Thus, the recording head 1 performs the recording (printing) operation.

As long as the recording conditions remain unchanged, the drive-waveform data signal DATA whose data is divided into the twelve portions and which is for generating the drive-waveform signals FIRE01-06 is iteratively read out by the gate array 14 and iteratively outputted as the drive-waveform signals FIRE01-06 from the first and second serial-parallel conversion portions 41, 42. The recording apparatus 100 according to this embodiment is driven such that the length of each drive-waveform signal FIRE01-06 corresponds to a record period of one dot (that conforms to the period of the latch signal LAT1 inputted to the main latch circuit 32).

In the ink-jet recording apparatus for color recording, the drive-waveform signals for respective recording heads provided for respective different colors of inks are determined depending upon the characteristics of the respective inks. In this respect, the drive-waveform-data signal for all of the recording heads is serially transmitted and converted into parallel signals, namely, a plurality of drive-waveform signals for the respective recording heads. In this instance, each of the serial-parallel conversion circuits 41A, 42A of the respective first and second serial-parallel conversion portions 41, 42 may have an output bit number represented as: the number of drive-waveform signals×the number of recording heads×½. Alternatively, the first and second serial-parallel conversion portions 41, 42 may be provided for each recording head and the drive-waveform-data signal may be serially transmitted from the gate array 14 to each recording head.

While the preferred embodiments of the present invention have been described in detail by reference to the drawings, it is to be understood that the present invention may be otherwise embodied.

For instance, in the illustrated first and second embodiments, the drive-waveform-data signal (DATA1 and DATA2; DATA) may be suitably rewritten so that the drive-waveform signals (FIRE01-04; FIRE01-06) are changed depending upon the recording conditions. The rewritten drive-waveform signals may be transmitted from the host computer 26 and stored in the RAM 12 or the image memory 25. For instance, when image data for permitting substantially simultanelous ejection of ink droplets from a multiplicity of nozzles is transmitted from the host computer 26, the drive-waveform-data signal (DATA1 and DATA2; DATA) which is set such that a multiplicity of drive pulses do not overlap may be transmitted together with the image data for the purpose of reducing the peak of the power to be consumed or avoiding the crosstalk phenomenon.

The drive-waveform-data signal (DATA1 and DATA2; DATA) outputted from the gate array 14 may be arranged to be corrected depending upon environmental conditions such as temperature.

While the ink-jet type recording apparatus has been described above as the preferred embodiments of the present invention, the principle of the invention is equally applicable to a recording apparatus employing an impact-type recording head, a thermal-type recording head or the like. Further, the principle of the invention may be applied to not only the tone control in the recording density, but also history control. More specifically described, in the impact-type recording head, the drive-waveform signal may be selected, by considering vibration remaining in impact elements, on the basis of presence or absence of record data before and after printing action. In the thermal-type recording head, the drive-waveform signal may be selected, by considering heat remaining in heat-generating elements, on the basis of presence or absence of record data before and after printing action.

It is to be understood that the present invention my be embodied with various other changes and modifications, which may occur to those skilled in the art, without departing from the spirit and scope of the invention defined in the appended claims.

What is claimed is:

1. A recording apparatus comprising:

a recording head having a plurality of actuators for performing dot printing;

a drive circuit which outputs respective drive pulses to the respective actuators; and a main circuit which transmits, to the drive circuit, a drive signal for outputting the respective drive pulses to the respective actuators, wherein the drive signal transmitted by the main circuit to the drive circuit includes selection data for selecting, for each of the actuators, a drive-waveform signal which provides a waveform of each of the drive pulses to be outputted to the respective actuators, among plural sorts of drive-waveform signals, wherein the main circuit transmits, to the drive circuit, a clock signal and a drive-waveform-data signal that is a serial signal in which is included data to generate the plural sorts of drive-waveform signals, wherein the drive circuit includes a drive-waveform-signal generating circuit which generates the plural sorts of drive-waveform signals on the basis of the clock signal and the drive-waveform-data signal, wherein the drive circuit selects, for each of the actuators, one of the plural sorts of drive-waveform signals generated by the drive-waveform-signal generating circuit and outputs, to each of the actuators, the drive pulse which is based on said one of the plural sorts of drive-waveform signals selected for said each of the actuators, and wherein the drive-waveform generating circuit generates:

at least one sort of first drive-waveform signal as a first part of the plural sorts of drive-waveform signals on the basis of states of the drive-waveform-data signal which correspond to rising edges of clock pulses of the clock signal; and at least one sort of second drive-waveform signal as a second part of the plural sorts of drive-waveform signals on the basis of states of the drive-waveform-data signal which correspond to falling edges of the clock pulses of the clock signal.

2. The recording apparatus according to claim 1, wherein the drive-waveform-signal generating circuit includes a first circuit portion which generates the at least one sort of first drive-waveform signal and a second circuit portion which generates the at least one sort of second drive-waveform signal.

3. The recording apparatus according to claim 2, wherein the first circuit portion includes a first serial-parallel conversion portion which generates some of the plural sorts of drive-waveform signals as one part thereof by conducting serial-parallel conversion of the drive-waveform-data signal on the basis of the rising edges of the clock pulses of the clock signal, and wherein the second circuit portion includes a second serial-parallel conversion portion which generates some of the plural sorts of drive-waveform signals as another part thereof, by conducting serial-parallel conversion of the drive-waveform-data signal on the basis of the falling edges of the clock pulses of the clock signal.

4. The recording apparatus according to claim 3, wherein the main circuit transmits a latch signal to the drive circuit, and wherein the first serial-parallel conversion circuit generates said some of the plural sorts of drive-waveform signals as said one part thereof in accordance with the latch signal while the second serial-parallel conversion circuit generates said some of the plural sorts of drive-waveform signals as the another part thereof in accordance with the latch signal.

5. The recording apparatus according to claim 4, wherein the latch signal includes a plurality of pulses whose period corresponds to a time length including a predetermined plural number of clock pulses of the clock signal, wherein the first serial-parallel conversion portion generates each of said some of the plural sorts of drive-waveform signals as said one part thereof, on the basis of the rising edge of a corresponding one of the predetermined plural number of the clock pulses, and wherein the second serial-parallel conversion portion generates each of said some of the plural sorts of drive-waveform signals as the another part thereof, on the basis of the falling edge of a corresponding one of the predetermined plural number of the clock pulses.

6. The recording apparatus according to claim 5, wherein the drive-waveform-data signal is a serial signal in which is included:

data relating to a portion of a pulse waveform of each of said some of the plural sorts of drive-waveform signals generated by the first serial-parallel conversion portion, in the time length including the predetermined plural number of the clock pulses; and data relating to a portion of a pulse waveform of each of said some of the plural sorts of drive-waveform signals generated by the second serial-parallel conversion portion, in the time length including the predetermined plural number of the clock pulses.

7. The recording apparatus according to claim 1, wherein the drive-waveform-signal generating circuit includes a serial-parallel conversion portion which generates some of the plural sorts of drive-waveform signals as at least a part thereof, by conducting serial-parallel conversion of the drive-waveform-data signal on the basis of clock pulses of the clock signal.

8. The recording apparatus according to claim 7, wherein the main circuit transmits a latch signal to the drive circuit, and wherein the serial-parallel conversion portion generates said some of the plural sorts of drive-waveform signals in accordance with the latch signal.

9. The recording apparatus according to claim 8, wherein the latch signal includes a plurality of pulses whose period corresponds to a time length including a predetermined plural number of clock pulses of the clock signal, and wherein the serial-parallel conversion portion generates each of said some of the plural sorts of drive-waveform signals on the basis of a corresponding one of the predetermined plural number of the clock pulses.

10. The recording apparatus according to claim 9, wherein the drive-waveform-data signal is a serial signal in which is included data relating to a portion of a pulse waveform of each of said some of the plural sorts of drive-waveform signals generated by the serial-parallel conversion portion, in the time length including the predetermined plural number of the clock pulses.

11. The recording apparatus according to claim 1, further comprising a main body and a carriage which is disposed in the main body and which holds the recording head so as to move the recording head along a recording medium, wherein the drive circuit is mounted on the carriage while the main circuit is accommodated in the main body, and wherein the recording apparatus further comprises a flexible cable which connects the drive circuit and the main circuit to each other for transmission of the drive signal, the clock signal and the drive-waveform-data signal from the main circuit to the drive circuit.

12. The recording apparatus according to claim 1, wherein the recording head has a plurality of ink chambers which respectively correspond to the plurality of actuators and which accommodate ink, and wherein the recording head is arranged to eject droplets of the ink such that each of the actuators changes a volume of a corresponding one of the ink chambers on the basis of a corresponding one of the drive pulses inputted thereto.

* * * * *